United States Patent [19]

Van Rens

[11] Patent Number: 4,821,789

[45] Date of Patent: Apr. 18, 1989

[54] VENETIAN BLIND WITH IMPROVED LADDER TILT DRUM

[75] Inventor: Mark R. Van Rens, Middleton, Wis.

[73] Assignee: Graber Industries, Inc., Middleton, Wis.

[21] Appl. No.: 135,241

[22] Filed: Dec. 21, 1987

[51] Int. Cl.[4] ..... E06B 9/38

[52] U.S. Cl. ..... 160/176.1; 160/177; 24/543

[58] Field of Search ..... 160/176.1, 177, 168.1, 160/178.1, 172, 178.3; 24/119, 543, 487, 120, 518

[56] References Cited

U.S. PATENT DOCUMENTS

| | | | |
|---|---|---|---|
| 819,884 | 5/1906 | Higgins | 24/120 |
| 2,667,220 | 1/1954 | Rutledge | 160/177 |
| 3,156,295 | 11/1964 | Vecchiarelli et al. | 160/175 |
| 3,189,082 | 6/1965 | Hennequin | 160/178.1 |
| 3,289,739 | 12/1966 | Hensel | 160/178.1 |
| 3,333,905 | 8/1967 | Hennequin | 160/177 X |
| 3,352,349 | 11/1967 | Hennequin | 160/178.1 X |
| 3,605,852 | 9/1971 | Vecchiarelli | 160/168.1 |
| 3,918,513 | 11/1975 | Englund et al. | 160/176 |
| 4,416,320 | 11/1983 | Nordia | 160/177 |
| 4,484,612 | 11/1984 | Vecchiarelli | 160/177 |
| 4,494,593 | 1/1985 | Fielder, Jr. | 160/177 |
| 4,531,563 | 7/1985 | Nilsson et al. | 160/168.1 |
| 4,697,629 | 10/1987 | Anderson | 160/177 |
| 4,715,094 | 12/1987 | Herdman | 24/119 |

FOREIGN PATENT DOCUMENTS

| | | | |
|---|---|---|---|
| 282057 | 1/1967 | Australia | 160/178.1 |

OTHER PUBLICATIONS

"Snap-On Tassle for Fashionpleat".

*Primary Examiner*—Ramon S. Britts
*Assistant Examiner*—David M. Purol
*Attorney, Agent, or Firm*—Vernon J. Pillote

[57] ABSTRACT

A tilt drum for securing the upper ends of the side cords of a cord-type ladder to a venetian blind tilt rod for operation thereby. The tilt drum is formed with a one-piece body of synthetic resin material and includes a drum section adapted for mounting on the tilt rod and a cover section integrally connected by a flexible hinge portion to the drum section. The drum section has a top wall overlying the tilt rod and interfitting ribs are provided on the cover section and the top wall of the drum section for clamping end portions of the side cords of the ladder tape to the drum section, when the cover section is closed. A latch is formed integrally with the cover section and arranged to engage a keeper on the drum section to latch the cover section in a closed position.

8 Claims, 2 Drawing Sheets

Fig. 1.
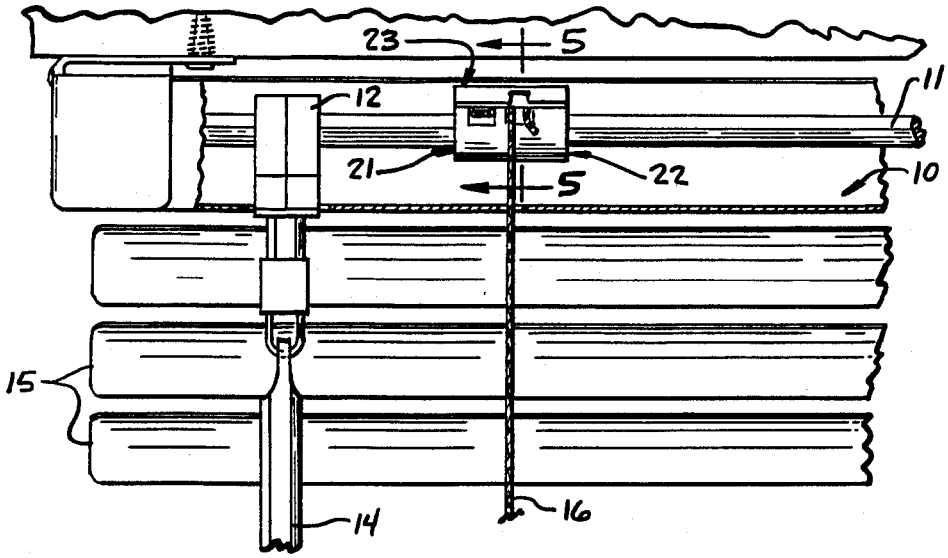
Fig. 2.
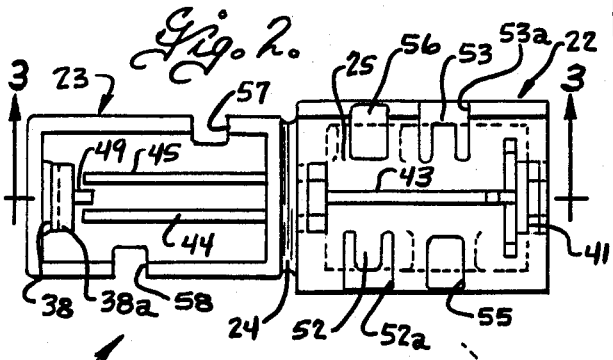
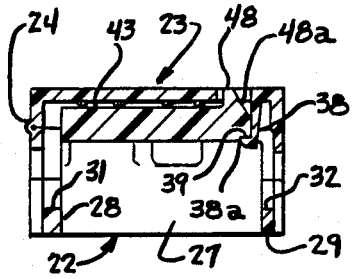
Fig. 4.
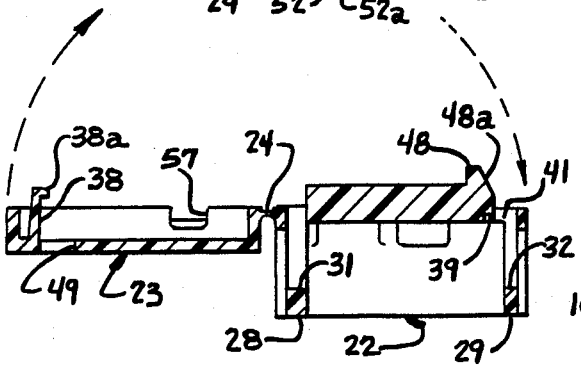
Fig. 3.
Fig. 5.
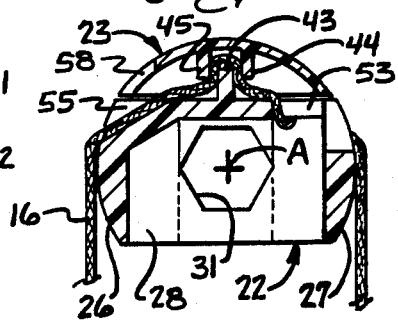

VENETIAN BLIND WITH IMPROVED LADDER TILT DRUM

PRIOR ART

Various different venetian blind ladder tilt drums have heretofore been made for attaching the upper ends of the ladders to the venetian blind tilt rod for operation thereby. Some tape drums such as disclosed in U.S. Pat. No. 3,156,295 require that the upper ends of the side tapes or cords be preformed into loops and fastened upon themselves by staples or the like prior to assembly on the tape drum. Others such as disclosed in U.S. Pat. Nos. 3,333,905; 3,605,852; 3,918,513, 4,484,612 and 4,697,629 require that knots, bayonets, beads, or the like be formed on or attached to the ends of the ladder tape prior to assembly on the tape drum. Such preforming the ends of the ladder tapes increases the cost of the overall blind assembly.

Some tape drums such as shown in U.S. Pat. Nos. 3,189,082; 4,416,320; 4,494,593 and 4,531,563, do not require preforming of loops, knots, bayonets or beads on the ends of the ladder tape prior to assembly on the drum. U.S. Pat. No. 3,189,082 discloses a tape drum formed of metal and having two clamps mounted for pivotal movement about axes paralleling the tilt drum, for individually clamping the two side tapes of a ladder to the drum. U.S. Pat. No. 4,416,320 discloses a tape drum with a C-shape clamp member for clamping the ends of the ladder to the drum. U.S. Pat. No. 4,531,563 incorporates metal tabs attached to the tape drum and which are deformed to clamp the ends of the ladder to the drum. The tape drum in U.S. Pat. No. 4,494,593 uses a one-piece drum design. However, this patent discloses utilizing the upper ladder rung to index and connect the upper end of the ladder to the drum in a manner such that the ladder tape cannot be assembled on the tape drum after the tape drum is assembled on the venetian blind tilt rod.

SUMMARY OF THE INVENTION

It is an object of the present invention to provide a venetian blind ladder tilt drum which can be economically formed in one piece and which simplifies assembly of the ladder on the drum without requiring preforming of the ends of the ladder tape with loops, knots, bayonets, beads or the like.

Accordingly, the present invention provides a tilt drum for securing cord type ladder means to a tilt rod of venetian blind where the ladder means comprises a pair of side cords joined by cross rungs. The drum comprises a one-piece body of synthetic resin material including a drum section and a cover section integrally connected by a flexible hinge portion to the drum section, the drum section having a tilt axis and including a top wall means overlying the tilt axis and opposed side wall means spaced generally equidistant from the tilt axis and opposed end wall means extending transverse to the tilt axis, the end wall means having passage means therein adapted to receive the tilt rod. The flexible hinge portion extends transverse the tilt axis adjacent one of the end wall means and is sufficiently flexible to allow the cover section to be swung from an open position spaced from the top wall means to a closed position overlying the top wall means, and latch means integral with the cover section and drum section are provided at a location adjacent the other end wall means for latching the cover section in a closed position with a lower face of the cover section opposed to an upper face of the top wall means. Ridge means are provided on the opposed faces of the base section and cover section and extend generally longitudinally of the tilt axis at a location intermediate the side walls of the drum section for gripping end portions of the ladder side cords therebetween when the cover section is in a closed position.

The top wall means of the base section is advantageously provided with two ears at relatively opposite sides of the tilt axis and each extending away from the tilt axis so that an end portion of each side cord of the ladder tape can be passed from one side of the drum section over the ridge means on the drum section and looped around a respective one of the ears and then passed back over the ridge means to effect a double clamping of each side cord.

DESCRIPTION OF THE DRAWINGS

FIG. 1 is a fragmentary side view of a venetian blind embodying the tilt drum of the present invention;

FIG. 2 is a top view of the venetian blind tilt drum with the cover in an open position;

FIG. 3 is a longitudinal sectional view through the tilt drum taken on the plane 3—3 of FIG. 2;

FIG. 4 is a longitudinal sectional view through the tilt drum showing the cover in a closed condition;

FIG. 5 is a transverse sectional view through the tilt drum taken on the plane 5—5 of FIG. 1.

Figure 6:
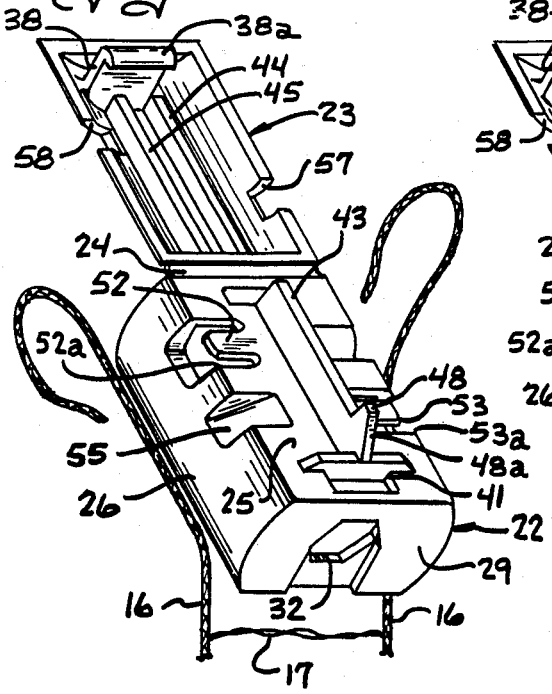
FIGS. 6–9 are exploded perspective views of the tilt drum illustrating the manner of assembly and clamping of the ladder side cords to the tilt drum.

Referring first to FIG. 1, there is shown a venetian blind including a head rail 10, conveniently of channel-shaped construction and having a tilt rod 11 supported for rotation about an axis extending lengthwise of the head rail and a tilt rod rotating means 12 of conventional construction, such as a worm and worm wheel drive operated by a wand 14. A plurality of slats 15 are supported on ladder means of the type including a pair of flexible side cords 16 and cross rungs 17 (FIGS. 6–9) and the upper ends of the side cords 16 are attached to and supported on a tape drum 21 for operation by the venetian blind tilt rod 11.

The tape drum 21 is formed in a one-piece body of synthetic resin material of a type which is rigid in relatively thick sections and which is bendable without breaking in relatively thin sections, for example nylon. The one-piece body comprises a drum section 22 and a cover section 23 that is integrally connected by a thin flexible hinge portion 24 to the drum section. The drum section includes a top wall 25 adapted to overlie the tilt rod 11 and opposed side walls 26 and 27 that are spaced generally equidistant from the tilt rod and opposed end walls 28 and 29 that extend transverse through the tilt rod. Passages 31 and 32 are formed in the end walls for non-rotatably receiving the venetian blind tilt rod 11 and the passages define a drum tilt axis A (FIG. 5) coaxial with the axis of rotation of the tilt rod 11.

Figure 7:
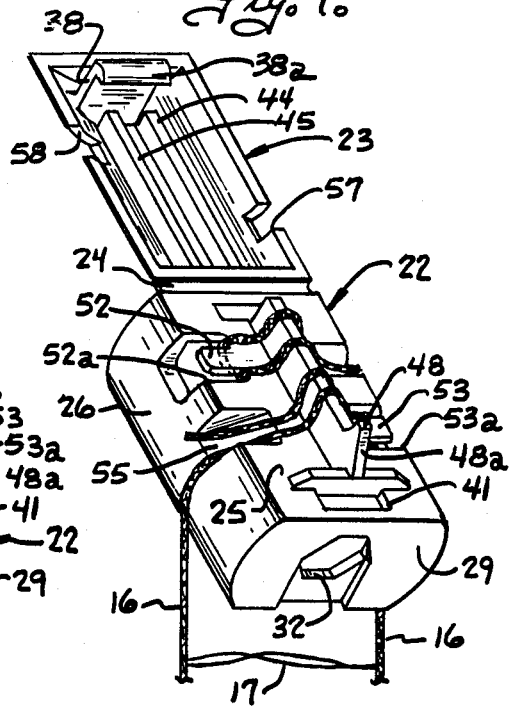

The hinge portion 24 extends crosswise of the drum tilt axis A and connects one end of the cover section 23 to one end wall 28 of the drum section at a level adjacent the upper face of the top wall 25. The cover section is swingable from an open position as shown in FIGS. 2, 3, 6 and 7 to a closed position as shown in FIGS. 1, 4, 5 and 9. When the cover section is in its closed position, the lower face of the cover section overlies the upper face of the top wall 25 and latch and keeper means are formed integrally with the cover section and drum section to latch the cover section in its closed position. More particularly, the cover section is formed with a latch 38 that extends downwardly from the lower face of the cover section and which has a latch nose 38*a* on its distal end arranged to engage a keeper 39 on the top wall at the end adjacent the end wall 29. As shown, the keeper 39 is located at the underside of the top wall 25 and the top wall 25 has an opening 41 at a location to allow the latch to pass therethrough into engagement with the keeper. The latch nose is preferably beveled as best shown in FIGS. 4, 6 and 7 to cam the latch laterally as it is moved through the opening, until the nose reaches the keeper 39.

The side cords 16 of the flexible ladder are arranged to extend upwardly along the sides 26 and 27 of the tilt drum and across the top wall 25. Rib means are provided on the upper side of the top wall of the drum section and at the lower side of the cover section for clamping the upper end portions of the side cords to the drum section. The rib means extends longitudinally of the tilt axes of the drum and, in the preferred embodiment illustrated, the rib means includes a rib 43 that projects upwardly from the top wall 25 of the drum section at a location intermediate the side walls 26 and 27, and a pair of ribs 44 and 45 that project downwardly from the lower side of the cover at locations to straddle the rib 43 on the drum section, when the cover is in its closed position as shown in FIG. 5. As best shown in FIG. 5, the ribs 44 and 45 extend downwardly from the cover section a distance to project below the level of the top of the rib 43 on the drum section when the cover is closed, to draw the end portions of the side cords of the ladder downwardly along the rib 43 and form a series of sharp bends in the upper ends of the side cords as they pass over the ribs. The ribs 44 and 45 on the cover are located to straddle opposite sides of the rib on the drum section and to be spaced from the rib on the body a distance less than the thickness of the ladder side cords 16 so as to apply pinching force to the ladder cords when the cover is closed. An upwardly extending prong 48 is formed on the end of the rib 43 on the drum section and arranged to extend through a notch 49 in the cover section. The prong 48 prevents the ladder cords from slipping off the end of the rib 43 and the face 48a of the prong is inclined as shown to aid in camming the nose on the latch 38 past the keeper on the drum section during closing of the cover.

Provision is advantageously made for clamping each side cord of the ladders to at least two locations, to minimize the likelihood of a side cord slipping relative to the tilt drum. In the preferred embodiment illustrated, the drum section is formed with a pair of laterally extending ears 52 and 53 at relatively opposite sides of the rib means and at locations such that one side cord of the ladder can be passed from one side 27 of the drum section and across the rib 43 on the top wall and around one of the ears 52 and then back over the rib, and the other side cord 16 passed from the other side 26 and across the rib 43 on the top wall of the drum section and around the other ear 53 and then back over the rib 43, as shown in FIG. 7. The ears 52 and 53 are preferably longitudinally offset relative to each other to avoid overlapping of the side cords when they are looped around the ears 52 and 53. With this arrangement, the ribs 44 and 45 on the cover section will clamp each side cord to the rib 43 on the drum section at two locations, when the cover is closed. As shown, ears 52 and 53 are conveniently formed in openings 52a and 53a respectively in the top wall of the drum section, and the ears extend laterally away from the tilt axis. Notches 55 and 56 are conveniently formed in the drum section at the intersection of the top wall with the side walls and at longitudinal locations opposite the ears 52 and 53 respectively, and notches 57 and 58 are formed in the cover at locations to register with notches 55 and 56, to provide clearance for the side cords when the cover section is closed.

Figure 8:
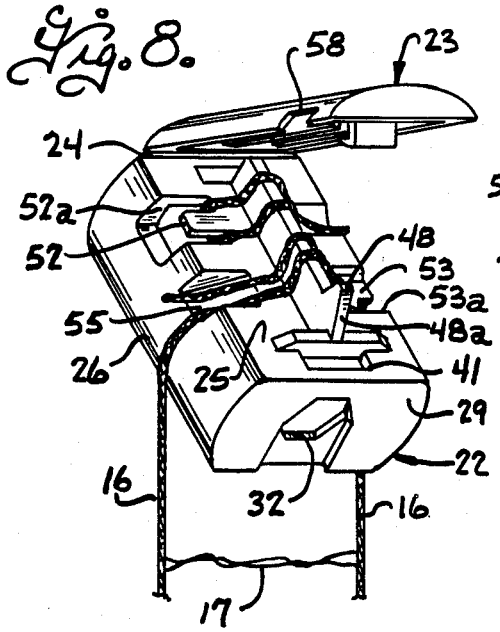
Figure 9:
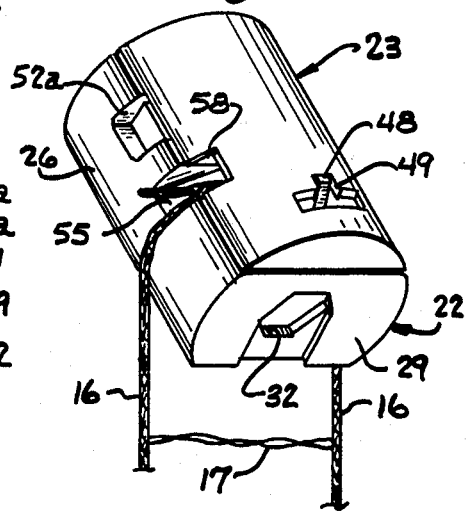

From the foregoing it is believed that the construction and manner of assembly of the ladder cords on the tilt drum will be readily understood. The tilt drum can be economically molded in one piece from synthetic resin material of a type that is relatively rigid in thick sections and sufficiently flexible thin sections to be bendable without breaking. The tape drum is molded with the cover section in an open condition as shown in Figs. 2, 3, 6 and 7 and the side cords of the ladder can be assembled on the tape drum either prior to or after assembly of the tape drum on the venetian blind tilt rod 11. The tape drum does not require preforming of loops or knots in the side cords of the ladder or the preassembly of bayonets, beads or the like on the ends of the ladder side cords. Instead, the ladder side cords are simply passed from respective ones of the side walls of the drum section and across the rib 43 on the top wall and looped around a respective one of the ears and passed back over the rib, as shown in FIGS. 7 and 8. When the cover section is closed, the ribs on the cover straddle the rib on the top wall of the drum section to clamp the end portions of the side cords to the drum section at several locations. The latch 38 on the cover section engages the keeper 39 on the drum section to latch the cover in its closed position.

The embodiments of the invention in which an exclusive property or privilege is claimed are defined as follows:

1. In a venetian blind having a tilt rod, slat support ladder means, and a tape drum for securing the ladder means to the tilt rod for operation thereby, the ladder means including a pair of flexible side cords joined by cross rungs, the improvement wherein the tape drum comprises a one-piece body of synthetic resin material including a drum section and a cover section integrally connected by a flexible hinge portion to the drum section, the drum section having a tilt axis and passage means on the tilt axis adapted to receive the tilt rod, the drum section having top wall means overlying the tilt axis and two sides spaced generally equidistant from the tilt axis and two ends extending transverse to the tilt axis, the flexible hinge portion extending transverse to the tilt axis adjacent one end of the drum section and being sufficiently flexible to allow the cover section to be swung from an open position space from the top wall means to a closed position overlying the top wall means, latch means integral with the drum and cover sections at a location spaced from the hinge portion for latching the cover section to the drum section in a closed position with the lower face of the cover section opposed to an upper face of the top wall means, the two side cords having upper end portions extending from relatively opposite sides of the drum section and across the top wall means, and ridge means on the opposed faces of the drum section and cover section extending generally longitudinally of the tilt axis and intermediate the sides of the drum section for gripping the end portions of the side cords therebetween when the cover section is in its closed position.

2. A venetian blind according to claim 1 wherein said drum section has two ears at relatively opposite sides of the tilt axis and each arranged so that an end portion of a respective one of the side cords extending across the top wall means can be looped therearound and passed back over the top wall means.

3. A venetian blind according to claim 2 wherein the two ears are offset from each other in a direction longitudinally of the tilt axis.

4. A venetian blind according to claim 1 wherein top wall means has two ears formed therein at relatively opposite sides of the tilt axis and each extending away from the tilt axis so that an end portion of a respective one of the side cords can be looped therearound.

5. A venetian blind according to claim 1 wherein said ridge means includes at least one rib on one of the opposed faces and a pair of ribs on the other of the opposed faces adapted to straddle said one rib and spaced from said one rib a distance less than the thickness of the side cords to pinch the side cords therebetween when the cover section is closed.

6. A venetian blind according to claim 1 wherein said ridge means includes at least one rib on one of the opposed faces and a pair of ribs on the other of the opposed faces adapted to straddle said one rib when the cover section is closed.

7. A venetian blind according to claim 5 wherein said top wall means has two ears formed therein at relatively opposite sides of the tilt axis and each extending away from the tilt axis so that an end portion of a respective one of the side cords can be looped therearound.

8. A venetian blind according to claim 2 wherein said ridge means includes at least one rib on one of the opposed faces and a pair of ribs on the other of the opposed faces adapted to straddle said one rib and spaced from said one rib a distance less than the thickness of the side cords to pinch the side cords therebetween when the cover section is closed.

* * * * *